United States Patent [19]

Brewen et al.

[11] Patent Number: 4,872,706

[45] Date of Patent: Oct. 10, 1989

[54] POSTAGE AD LABELS

[75] Inventors: Ronnie M. Brewen, Houston; David A. Lloyd, Conroe, both of Tex.

[73] Assignee: American Stamp, Inc., Houston, Tex.

[21] Appl. No.: 166,754

[22] Filed: Mar. 2, 1988

Related U.S. Application Data

[63] Continuation of Ser. No. 862,757, May 13, 1986, abandoned.

[51] Int. Cl.[4] ..... B42D 15/00; B42F 5/02; B65D 27/00

[52] U.S. Cl. ..... 283/81; 283/71; 229/70

[58] Field of Search ..... 283/1 R, 1 A, 51, 81, 283/71; 229/70

[56] References Cited

U.S. PATENT DOCUMENTS

| | | | |
|---|---|---|---|
| 1,005,696 | 10/1911 | Czettel | 283/81 |
| 2,532,011 | 11/1950 | Dahlquist et al. | 283/81 |
| 3,652,830 | 3/1972 | Kessler | 283/71 |
| 3,774,758 | 11/1973 | Sternberg | 283/81 |
| 3,974,311 | 8/1976 | Cherrin | 283/81 |
| 3,995,741 | 12/1976 | Henderson | 283/81 |
| 4,379,573 | 4/1983 | Lomeli et al. | 283/81 |
| 4,394,038 | 7/1983 | Klein | 283/81 |
| 4,585,254 | 4/1986 | Adams | 283/81 |

*Primary Examiner*—Frank T. Yost
*Assistant Examiner*—Paul M. Heyrana, Sr.
*Attorney, Agent, or Firm*—Arnold, White & Durkee

[57] ABSTRACT

The present invention provides a postage ad label assembly. In a preferred embodiment, the assembly includes a label having a print side onto which an advertisement can be printed and an adhesive side. A pressure sensitive adhesive is affixed to the adhesive side and releasably secures the label to a backing member. A postage stamp is affixed on the print side of said label. Said label can be peeled from said backing member and placed on an envelope to affix postage to the envelope for mailing.

14 Claims, 1 Drawing Sheet

POSTAGE AD LABELS

This is a continuation of Ser. No. 862,757, filed May 13, 1986, now abandoned.

BACKGROUND OF THE INVENTION

The present invention relates to postage containing labels. More particularly, the invention relates to postage labels which include a space for a printed advertisement.

Advertisers are continuously looking for novel ways to get the name and image of their products or services before consumers. Billions of dollars are spent in the United States each year for advertising through radio, television, newspapers, fliers, coupons and magazines. However, consumers have seen these advertising mediums so many times that their impact has decreased. Accordingly, it would be advantageous to provide a novel means of getting an advertisement before the consuming public.

Each day millions of pieces of mail are sent in the United States. Each piece of mail is handled and seen by many different individuals. Accordingly, it would be a significant advancement in the art to provide a novel means of combining advertisements with the mail. Such a system is disclosed and claimed herein.

SUMMARY OF THE INVENTION

The present invention provides a means to combine advertising with postage to be applied to pieces of mail. In particular, postage labels are provided which include a space for a printed advertisement and a space for a postage stamp.

In a preferred embodiment the present invention includes a label having a pressure sensitive adhesive on its back. The front face of the label includes a portion onto which an advertisement can be printed. A postage stamp is affixed to a portion of the front of the label.

A removable backing member is releasably attached to the pressure sensitive adhesive on the back surface of the label. The back side of the backing member also contains a surface onto which an advertisement can be printed. The label can be peeled from the backing member and applied to an envelope or package to provide postage.

In a second preferred embodiment, a plurality of labels are affixed to a long strip of backing so as to form a roll. Each label includes a major portion onto which an advertisement can be printed and a minor portion onto which a postage stamp can be affixed. This roll can then be fed into a machine which automatically places the labels onto envelopes.

DETAILED DESCRIPTION OF THE PREFERRED EMBODIMENTS

The present invention provides a postage ad label which can easily be affixed to a letter or other piece of mail. The invention is best understood by reference to the drawings in which like parts are designated with like numerals throughout.

Figure 1:
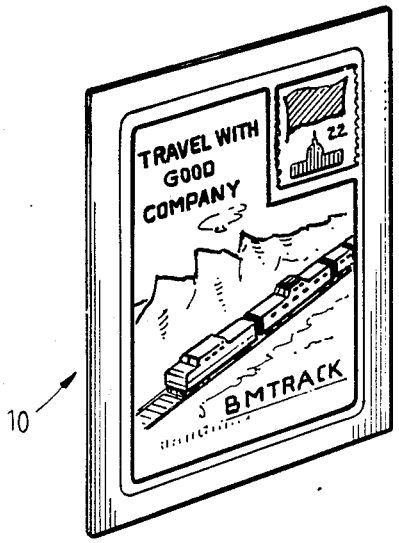
FIG. 1 is a perspective view of the front side of a first preferred embodiment of the invention.
Figure 2:
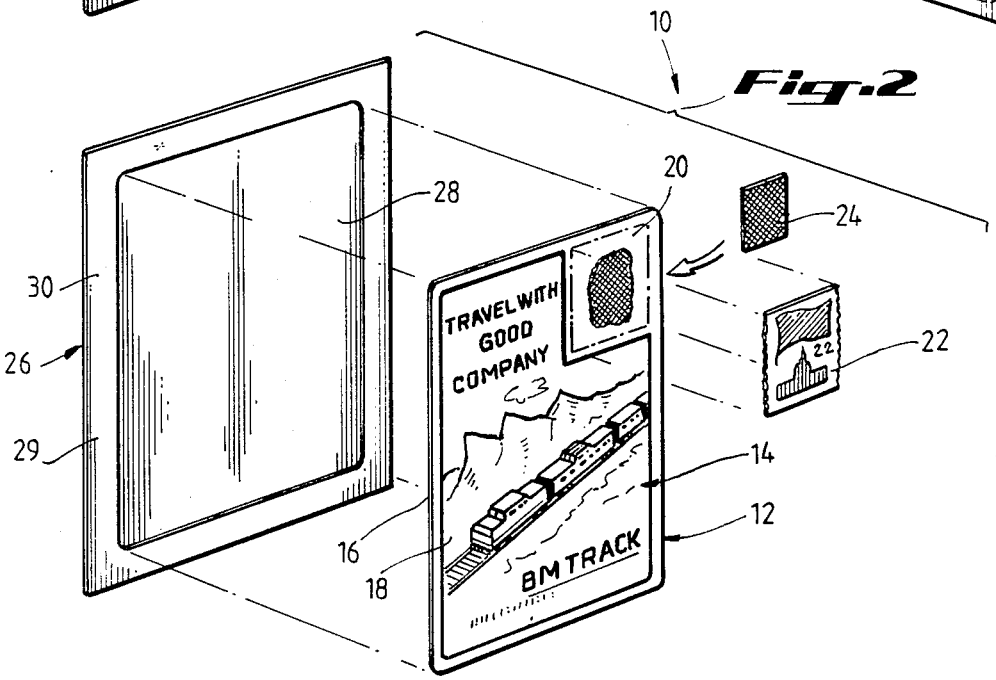
FIG. 2 is an exploded perspective view of the front side of the embodiment of FIG. 1.

Referring first to FIG. 1, a postage ad label in accordance with the present invention is illustrated and generally designated at 10. Referring to FIG. 2, postage ad label 10 includes a label 12 having a print side 14 and an adhesive side 16.

Print side 14 of label 12 includes a major portion 18 onto which an advertisement can be printed. Print side 14 also includes a minor portion 20 onto which a postage stamp 22 can be affixed. The area immediately around minor portion 20 is clear from printing such that stamp 22 can easily be identified. In the preferred embodiment, label 12 is white and opaque. However, other colors or transparent labels can also be used.

While stamps generally include a remoistening glue such that they can easily be affixed to an envelope or in this case to label 12, it has been found advantageous to include an additional adhesive 24 when applying stamp 22 to label 12. Common white glue can be used as adhesive 24 or two-sided adhesive patches can be utilized. Adhesive patches are preferred when the stamps are applied to the labels by high speed machinery to prevent sliding of the stamps. It will be appreciated by those skilled in the art that many different types of adhesive means can be utilized to affix stamp 22 to label 12. It should also be appreciated that the present invention can be prepared using only the remoistening glue on the stamps.

In the preferred embodiment, adhesive side 16 of label 12 includes a pressure sensitive adhesive. This adhesive releasably attaches label 12 onto a backing member 26. Backing member 26 includes a first side 28 for releasably engaging label 12. A mat 30 having a print side 29 surrounds label 12 on the first side 28 of backing member 26.

Figure 3:
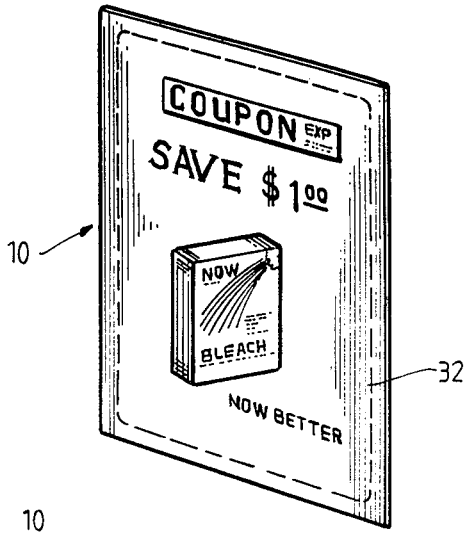
FIG. 3 is a perspective view of the rear side of the embodiment of FIG. 1.

In the preferred embodiment, backing member 26 includes a second side or back side 32 (see FIG. 3) which can also be printed upon. Accordingly, advertisements or coupons can be printed on second side 32 of backing member 26.

In use, a label 12 is peeled from backing member 26 and is applied to an envelope or other package. Inasmuch as a postage stamp 22 is already affixed to label 12, the envelope can then be placed in the mail.

Figure 4:
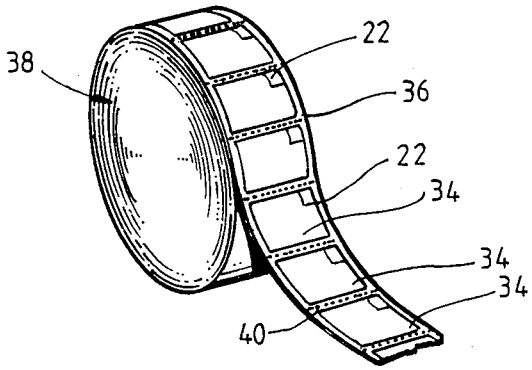
FIG. 4 is a perspective view of a second preferred embodiment in which the labels are assembled on a roll.

Referring now to FIG. 4, a second preferred embodiment of the present invention is illustrated. In this embodiment, a plurality of labels 34 are affixed to a long strip of backing member 36 to form a roll 38. Labels 34 are substantially identical in configuration to labels 12.

Roll 38 can be used on an appropriate machine to apply the postage ad labels automatically to large mailings. Additionally, backing member 36 of roll 38 can include perforations 40 such that one or more labels can be removed from the roll without removing the labels from the backing member.

While the present invention has been described with respect to the presently preferred embodiments, it will be appreciated by those skilled in the art that numerous changes and modifications could be made without departing from the scope or essential characteristics of the invention. For example, rather than using a pressure sensitive adhesive on the back of label 12, other types of adhesive such as remoistening adhesives could also be used. Additionally, adhesive can be applied at the time the label is affixed to an article of mail. Further, metered postage can be used in place of postage stamps.

Accordingly, the described embodiments are intended to be illustrative and not restrictive of the invention. All changes or modifications which come within the meaning and range of equivalency of the claims are to be embraced within their scope.

We claim:

1. A label assembly comprising:

a label having a print side and an adhesive side;

postage affixed on said print side of said label;

a backing member having a first side for releasably engaging said adhesive side of said label.

2. A label assembly as defined in claim 1 wherein said backing member includes a second side defining a print side.

3. A label assembly as defined in claim 1 wherein said postage comprises a postage stamp.

4. A label assembly as defined in claim 3 wherein said postage stamp is affixed to said label with glue.

5. A label assembly as defined in claim 3 wherein said postage stamp is affixed to said label with a two-sided adhesive patch.

6. A label assembly as defined in claim 1 further comprising a mat affixed to said backing member surrounding said label, said mat having a print side corresponding to said print side of said label.

7. A label assembly as defined in claim 1 wherein said backing member comprises a long strip for receiving a plurality of labels to form a roll.

8. A label assembly as defined in claim 1 wherein said backing member contains two labels mounted adjacent each other on said first side of said backing member.

9. A label assembly as defined in claim 1 wherein said labels are transparent.

10. A label assembly comprising:

a label having a print side and an adhesive side;

a postage stamp affixed to a portion of said print side of said label; and a backing member having a first side for releasably engaging said adhesive side of said label and a second side for printing.

11. A postage label assembly comprising:

a label having a print side and an adhesive side, said print side having a minor portion and a major portion;

an adhesive layer affixed to said adhesive side of said label;

postage affixed to said minor portion of said print side of said label; and an advertisement printed on said major portion of said label.

12. A postage label assembly as defined in claim 11 wherein said adhesive layer is applied to said label at the time of affixing said label to an article to be mailed.

13. A postage label assembly as defined in claim 11 wherein said adhesive layer comprises a pressure sensitive adhesive.

14. A postage label assembly as defined in claim 13 further comprising a backing member releasably affixed to said adhesive layer.

* * * * *